US008491235B2

(12) United States Patent
Omi et al.

(10) Patent No.: US 8,491,235 B2
(45) Date of Patent: Jul. 23, 2013

(54) RAIL DRILLING MACHINE

(75) Inventors: Shohei Omi, Anjo (JP); Kazuyoshi Inagaki, Anjo (JP)

(73) Assignee: Omi Kogyo Co., Ltd., Anjo-shi, Aichi-ken (JP)

( * ) Notice: Subject to any disclaimer, the term of this patent is extended or adjusted under 35 U.S.C. 154(b) by 1027 days.

(21) Appl. No.: 12/512,497

(22) Filed: Jul. 30, 2009

(65) Prior Publication Data

US 2011/0027026 A1 Feb. 3, 2011

(51) Int. Cl.
*B23B 45/14* (2006.01)

(52) U.S. Cl.
USPC ..... 408/76; 408/79

(58) Field of Classification Search
USPC ..... 408/76, 79, 236
IPC ..... B23B 45/14
See application file for complete search history.

(56) References Cited

U.S. PATENT DOCUMENTS 5,938,378 A 8/1999 Omi et al.

FOREIGN PATENT DOCUMENTS

| | | | |
|---|---|---|---|
| CN | 2175779 | | 8/1994 |
| CN | 2311509 | | 3/1999 |
| FR | 2669654 | A1 * | 5/1992 |
| GB | 2286352 | | 8/1995 |
| JP | 40-012165 | U | 5/1965 |
| JP | 09-131607 | A | 5/1997 |
| JP | 10-043920 | A | 2/1998 |
| JP | 2004-322238 | A | 11/2004 |
| RU | 2298609 | | 5/2007 |

OTHER PUBLICATIONS

English translation of FR 2669654 A1 acquired on Oct. 18, 2012 from espace.net.*

* cited by examiner

*Primary Examiner* — David Bryant
*Assistant Examiner* — Jason L Vaughan
(74) *Attorney, Agent, or Firm* — Marsh Fischmann & Breyfogle LLP

(57) ABSTRACT

In a state where a rail drilling machine is attached to a rail, a drive source, a cutter support mechanism, and a support base are arranged on one side of the rail. A support plate having an upper support surface and a lower support surface is provided on either end of the support base in the longitudinal direction. The upper support surface and the lower support surface of each support plate contact a lower surface of the rail head and an upper surface of the rail foot, respectively, so that the support base is prevented from moving vertically with respect to the rail. The support base has a magnetic sticking portion located between the support plates. The magnetic sticking portion has a sticking surface that is stuck to a side surface of the rail web. In a state where the sticking surface of the magnetic sticking portion is stuck to the side surface of the web, the cutter attaching portion of the cutter support mechanism is arranged in such a manner that a rotation axis of the cutter attaching portion extends, on the outer side of the support base, toward the web.

4 Claims, 3 Drawing Sheets

RAIL DRILLING MACHINE

BACKGROUND OF THE INVENTION

The present invention relates to a rail drilling machine for drilling, in the web of a rail, coupling holes for coupling the rail with a crosstie.

Conventionally, for example, Japanese Laid-Open Patent Publication No. 2004-322238 discloses a rail drilling machine. This rail drilling machine includes a rail holding mechanism that holds the web of a rail from both sides. The rail drilling machine drills coupling holes in the web of a rail while the rail holding mechanism straddles the head of the rail from above to hold the web.

When drilling coupling holes in a rail using the rail drilling machine of the above publication, the rail holding mechanism straddles the head of the rail from above and is arranged on either side of the rail. Thus, the coupling holes cannot be drilled in the rail while the rail remains laid to allow vehicles to pass.

SUMMARY OF THE INVENTION

It is an objective of the present invention to provide a rail drilling machine that is capable of drilling holes in the web of a rail while keeping the rail laid down to allow vehicles to pass.

To achieve the foregoing objective and in accordance with one aspect of the present invention, a rail drilling machine for drilling coupling holes in the web of a rail is provided. A head and a foot are formed in an upper portion and a lower portion of the rail, respectively, so as to extend along the longitudinal direction of the rail. The web is formed between the head and the foot so as to extend along the head and the foot. The rail drilling machine includes a drive source, a cutter support mechanism, and a support base. The cutter support mechanism has a cutter attaching portion that is driven by the drive source to rotate. The support base supports the drive source and the cutter support mechanism. In a state where the rail drilling machine is attached to the rail, the drive source, the cutter support mechanism, and the support base are located on one side in the widthwise direction of the head, foot, and web of the rail. A support plate having an upper support surface and a lower support surface is provided at each of both ends of the support base in a longitudinal direction, and wherein the upper support surface and the lower support surface of each support plate contact a lower surface of the rail head and an upper surface of the rail foot, respectively, so that the support base is prevented from moving vertically with respect to the rail. The support base has a magnetic sticking portion located between the support plates. The magnetic sticking portion has a sticking surface that is stuck to a side surface of the rail web. In a state where the sticking surface of the magnetic sticking portion is stuck to the side surface of the web, the cutter attaching portion of the cutter support mechanism is arranged in such a manner that a rotation axis of the cutter attaching portion extends, on the outer side of the support base, toward the web.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is a rear view showing the rail drilling machine and the rail as viewed from the opposite direction of FIG. 1(*a*);

FIG. 1(*c*) is a plan view illustrating the planar structure of a support plate in the rail drilling mechanism of FIG. 1(*a*);

FIG. 2(*b*) is a side view showing the rail drilling machine and the rail of FIG. 1(*a*) as viewed from the widthwise direction of the rail;

FIG. 2(*c*) is a side view showing a state where the drive source and the cutter support mechanism have been rotated by a predetermined angle from the state of FIG. 2(*b*);

FIG. 3(*c*) is a plan view illustrating the planar structure of the support plate used in the case shown in FIGS. 3(*a*) and 3(*b*).

DETAILED DESCRIPTION OF THE PREFERRED EMBODIMENTS

Figure 1:
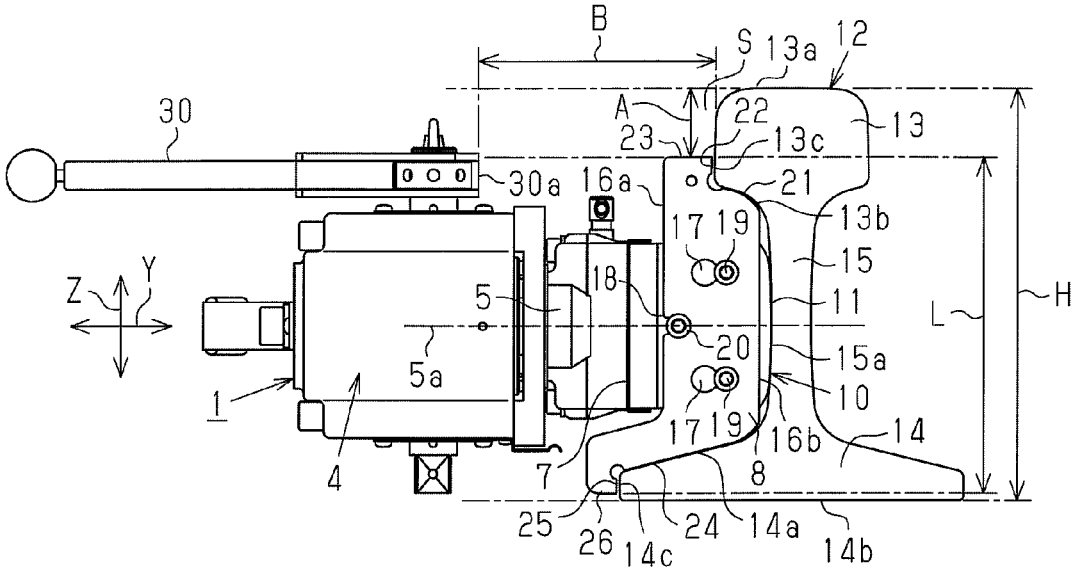
FIG. 1(*a*) is a front view illustrating a rail drilling machine of a magnetic fixing type and a rail as viewed along the longitudinal direction of the rail.
Figure 1:
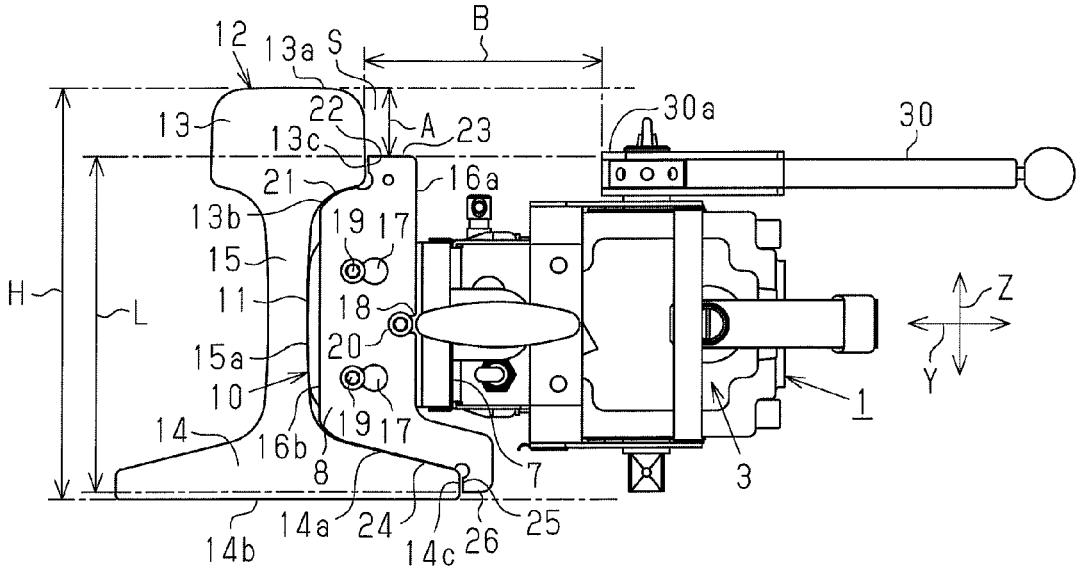
Figure 1:
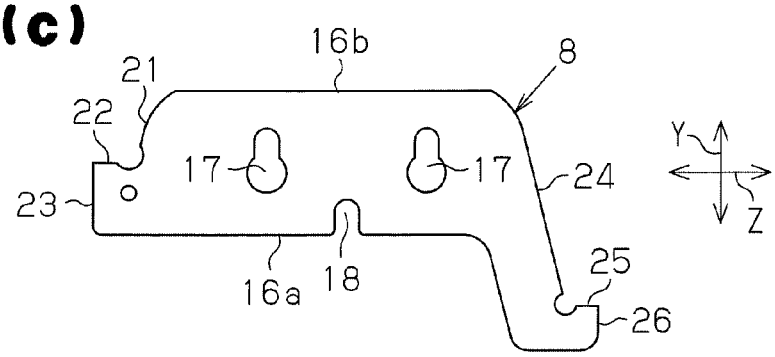
Figure 2A:
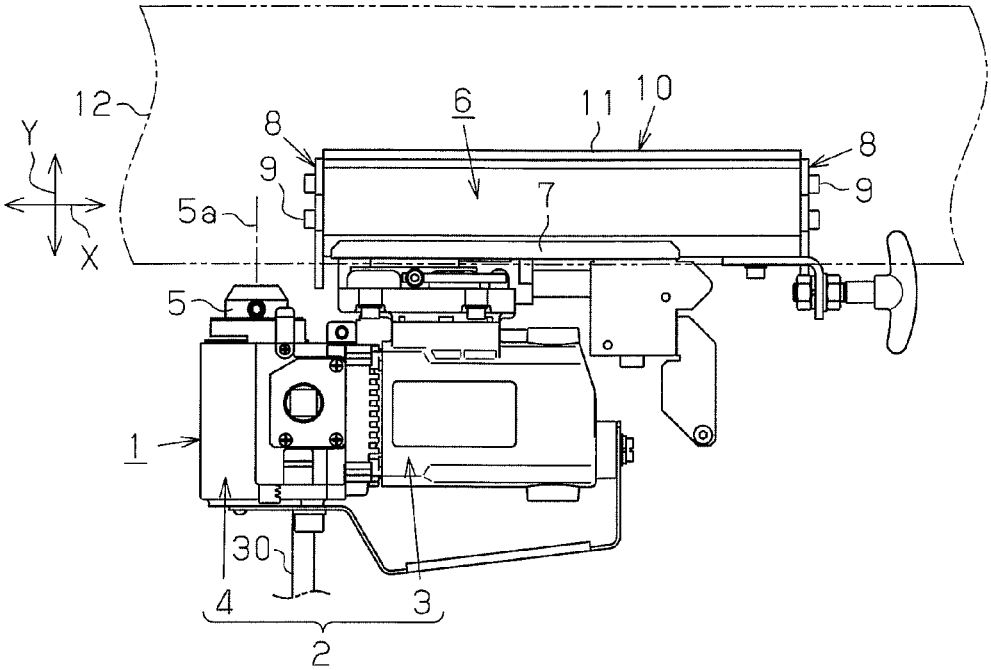
FIG. 2(*a*) is a plan view showing the rail drilling machine and the rail shown in the FIG. 1(*a*) as viewed from above.
Figure 2B:
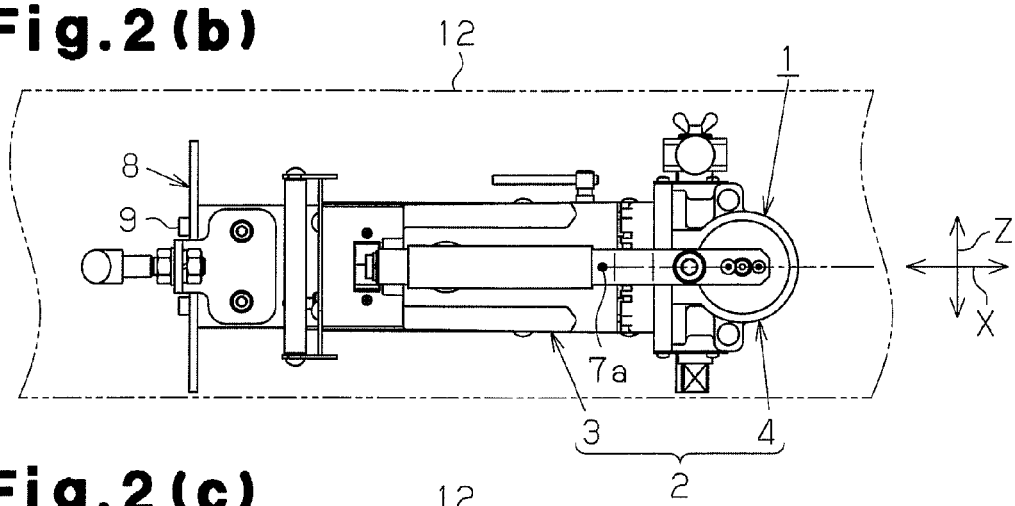
Figure 2C:
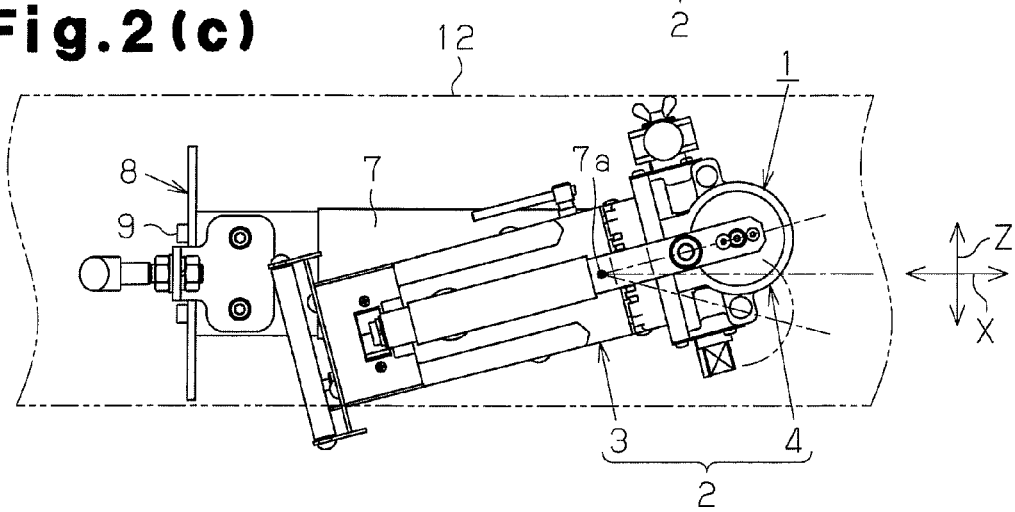

A rail drilling machine according to one embodiment of the present invention will now be described with reference to FIGS. 1(*a*) to 3(*c*). FIG. 1(*a*) is a front view illustrating a rail drilling machine and a rail as viewed along the longitudinal direction of the rail. FIG. 1(*b*) is a rear view showing the rail drilling machine and the rail as viewed from the opposite direction of the FIG. 1(*a*). FIG. 2(*a*) is a plan view showing the rail drilling machine and the rail of FIG. 1(*a*) as viewed from above. FIGS. 2(*b*) and 2(*c*) are side views showing the rail drilling machine and the rail as viewed from the widthwise direction of the rail.

As shown in FIGS. 1(*a*), 1(*b*), 2(*a*), and 2(*b*), a rail 12 extends along an X direction. A head 13 and a foot 14 are provided in an upper portion and a lower portion of the rail 12, respectively, so as to extend along the longitudinal direction of the rail 12, or in the X direction. A web 15 is located between the head 13 and the foot 14. The web 15 extends along the head 13 and the foot 14.

A magnetic fixing type rail drilling machine 1 is arranged on one side in the widthwise direction of the rail 12 (on the left as viewed in FIG. 1(*a*)). The rail drilling machine 1 includes an electric motor 3 serving as a drive source and a cutter support mechanism 4. The electric motor 3 and the cutter support mechanism 4 form a drive unit 2. The cutter support mechanism 4 has a cutter attaching portion 5, which operates with and is rotated by an output transmission mechanism of the electric motor 3.

The rail drilling machine 1 has a support base 6 that supports the electric motor 3 and the cutter support mechanism 4, that is, the drive unit 2. Of both sides of the support base 6, a slide base 7 is located on the side that faces the rail drilling machine 1. The slide base 7 is supported by the support base 6 so as to be movable along the longitudinal direction of the support base 6, that is, along the X-direction, with respect to the support base 6. The slide base 7 can be fixed at a predetermined position with respect to the support base 6. The drive unit 2 is supported by the slide base 7 so as to be rotatable about an axis 7*a* extending in a Y-direction, with respect to the slide base 7. The drive unit 2 can be fixed at a predetermined rotational position in relation to the slide base 7. FIG. 2(*c*) is a side view showing a state where the drive unit 2 has been rotated relative to the slide base 7 by a predetermined angle from the state of FIG. 2(*b*). A lever 30 for manipulating the drive unit 20 is provided above the drive unit 2. A proximal portion 30*a* of the lever 30 is fixed to the drive unit 20.

A support plate 8 is detachably coupled to each end of the support base 6 in the X-direction by means of fastening means 9. A magnetic sticking portion 10 having an sticking surface 11 is located between the support plates 8. The magnetic sticking portion 10 is detachably attached to one of the sides of the support base 6 that faces the rail 12.

Figure 3A:
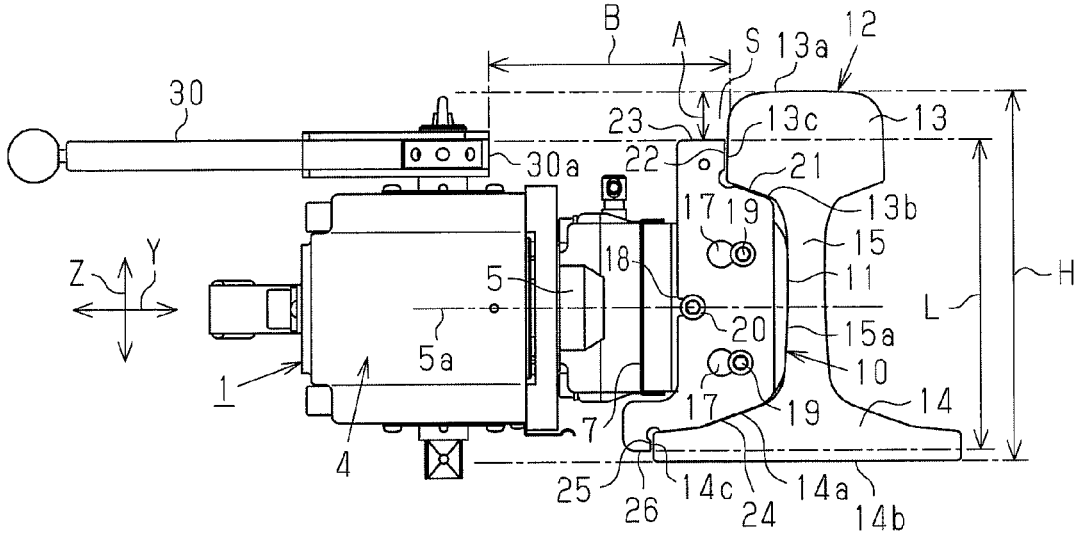
FIGS. 3(*a*) and 3(*b*) are front and rear views showing the state where the rail drilling machine of the present embodiment is attached to a rail having a different size from the rail shown in FIGS. 1(*a*) and 1(*b*)
Figure 3B:
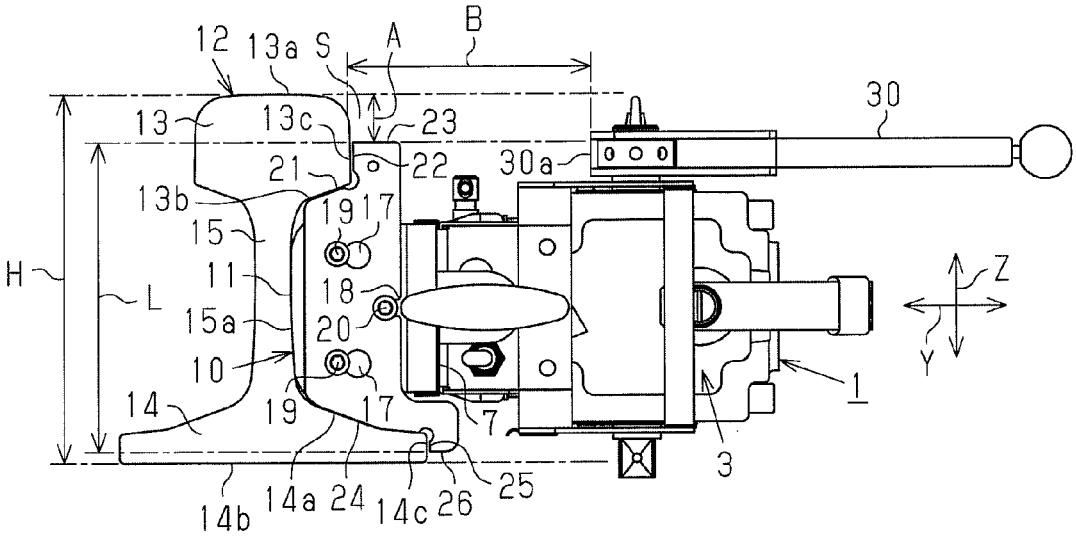
Figure 3C:
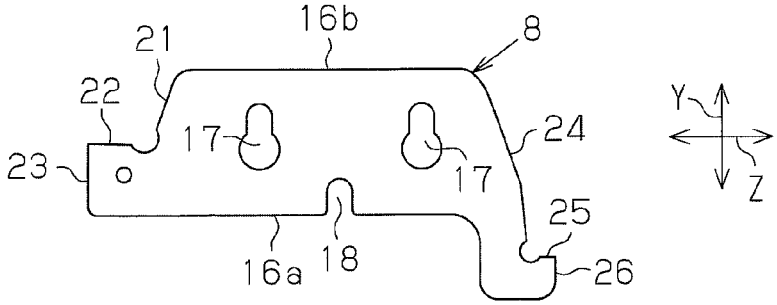

The rail 12 includes rails of different heights H, or the distance between the upper surface 13*a* of the head 13 and the lower surface 14*b* of the foot 14 shown in FIGS. 1(*a*) and 1(*b*). For example, the height of the rail 12 shown in FIGS. 3(*a*) and 3(*b*) is less than the height of the rail 12 shown in FIGS. 1(*a*) and 1(*b*). In the present embodiment, two types of support plates 8 shown in FIGS. 1(*c*) and 3(*c*) are prepared to correspond to the rails shown in FIGS. 1(*a*) and 1(*b*) and FIGS. 3(*a*) and 3(*b*). The support plate 8 shown in FIG. 1(*c*) has a relatively long length L, and the support plate 8 shown in FIG. 3(*c*) has a relatively short length L. FIGS. 1(*c*) and 3(*c*) are plan views illustrating the planar structure of the support plates 8.

As shown in FIGS. 1(*a*) to 1(*c*), each support plate 8 is substantially L-shaped. Two fastening holes 17 extend through a center portion of each support plate 8 in the widthwise direction, that is, in the Y-direction. The fastening holes 17 are arranged vertically, that is, along a Z-direction. The above described magnetic sticking portion 10 is located between side edges 16*b* of the support plates 8 (the right side in FIG. 1(*a*)), and the magnetic sticking surface 11 of the magnetic sticking portion 10 projects from the side edges 16*b* toward a side surface 15*a* of the web 15. At a side edge 16*a* of the support plate 8 (left edge as viewed in FIG. 1(*a*)), a U-shaped fastening hole 18, which is formed by cutting out, is located between the fastening holes 17.

Fastening screws 19, 20 are passed through the fastening holes 17, 18 and threaded to the support base 6 with a predetermined allowance with respect to the fastening holes 17, 18. The fastening holes 17, 18 and the fastening screws 19, 20 function as a movable adjusting portion that is capable of adjusting the position of the support plates 8 relative to the support base 6. Specifically, with the fastening screws 19, 20 loosened, the support plates 8 can be moved relative to the support base 6 in a range corresponding to the allowance between the fastening screws 19, 20 and the fastening holes 17, 18.

An upper end surface 23, which is substantially perpendicular to the side edge 16*b*, a side surface 22, which is continuous from below to and substantially perpendicular to the upper end surface 23, and an upper support surface 21, which connects the side surface 22 to the side edge 16*b*, are formed in an upper end portion of each support plate 8. A lower end surface 26, which is substantially perpendicular to the side edge 16*b*, a side surface 25, which is continuous from above to and substantially perpendicular to the lower end surface 26, and a lower support surface 24, which connects the side surface 25 to the side edge 16*b*, are formed in a lower end portion of each support plate 8. In this configuration, the upper end surface 23 is located at a higher position than the upper support surface 21, and the lower end surface 26 is located at a lower position than the lower support surface 24.

A method for attaching the magnetic fixing type rail drilling machine 1 will now be described.

First, the rail drilling machine 1 is placed at a side of the rail 12 in the widthwise direction with the support plates 8 loosened with respect to the support base 6, and the sticking surface 11 of the magnetic sticking portion 10 is stuck to the side surface 15*a* of the web 15. In this attached state, the electric motor 3, the cutter support mechanism 4, and the support base 6 are placed on one side in the widthwise direction of the head 13, the foot 14, and the web 15 of the rail 12. After the attached positions of the support plates 8 with respect to the rail 12 are adjusted, the support plates 8 are fastened to the support base 6 so that the upper support surface 21 of each support plate 8 contacts the lower surface 13*b* of the head 13, and the lower support surface 24 of each support plate 8 contacts the upper surface 14*a* of the foot 14. Accordingly, the support base 6 is prevented from moving along the Z-direction relative to the rail 12.

Further, the upper side surface 22 of each support plate 8 contacts the side surface 13*c* of the head 13, and the lower side surface 25 of the support plate 8 contacts the side surface 14*c* of the foot 14. The cooperation of the contact and the sticking motion of the magnetic sticking portion 10 prevent the support base 6 from moving along the Z-direction relative to the rail 12.

As shown in FIGS. 1(*a*) and 2(*a*), the cutter attaching portion 5 of the cutter support mechanism 4 is arranged such that the rotation axis 5*a* extends, on the outer side of the support base 6, toward the web 15. A cutter attached to the cutter attaching portion 5 is used to form coupling holes extending in the widthwise direction of the web 15. In this attached state, the upper end surface 23 of each support plate 8 is located lower than the upper surface 13*a* of the head 13 of the rail 12 by a distance A. A space S is formed between the upper end surface 23 and the side surface 13*c* of the head 13. The space S extends from the side surface 13*c* of the head 13 to the proximal portion 30*a* of the lever 30 and toward one side of the widthwise direction of the head 13 (leftward in FIG. 1(*a*)) by a distance B. In this attached state, the lower end surface 26 of each support plate 8 is located at a higher position than the lower surface 14*b* of the foot 14 of the rail 12.

The preferred embodiment has the following advantages.

(1) The sticking surface 11 of the magnetic sticking portion 10 of the support base 6 is stuck to the side surface 15*a* of the web 15, so that the rail drilling machine 1 is attached to the rail 12 while being arranged on a side of the rail 12 in the widthwise direction of the rail 12. Therefore, the rail drilling machine 1 does not straddle over the head 13 of the rail 12, and coupling holes can be formed in the web 15 of the rail 12 while the rail 12 remains laid to allow vehicles to pass.

(2) The space S is formed between the upper end surface 23 of each support plate 8 and the side surface 13*c* of the head 13. The space S prevents the wheels of a vehicle running over the upper surface 13*a* of the head 13 from contacting the rail drilling machine 1.

(3) The support plates 8 of the support base 6 and the magnetic sticking portion 10 prevent the support base 6 from moving in the Z-direction and the Y-direction with respect to the rail 12. Specifically, the upper support surface 21 of each support plate 8 contacts the lower surface 13*b* of the head 13, and the lower support surface 24 of the support plate 8 contacts the upper surface 14*a* of the foot 14, so that the support base 6 is prevented from moving in the Z-direction with respect to the rail 12. Further, the upper side surface 22 of each support plate 8 contacts the side surface 13*c* of the head 13, and the lower side surface 25 of the support plate 8 contacts the side surface 14*c* of the foot 14. The cooperation of the contact and the sticking motion of the magnetic sticking portion 10 prevent the support base 6 from moving along the Z-direction relative to the rail 12.

(4) The sticking surface 11 of the magnetic sticking portion 10 projects from the side edges 16*b* of the support plates 8 toward the side surface 15*a* of the web 15. Therefore, it is easy to cause the sticking surface 11 of the magnetic sticking portion 10 to contact and be stuck to the side surface 15*a* of the web 15.

(5) The support plates 8 are detachably attached to the support base 6 using the fastening means 9. Thus, replacement of the support plates 8 allows the rail drilling machine 1 to be attached to rails 12 of different sizes.

(6) The fastening means 9 includes the movable adjusting portion, which includes the fastening holes 17, 18 and the fastening screws 19, 20, and is capable of adjusting the positions of the support plates 8 relative to the support base 6. The movable adjusting portion adjusts the positions of the support surfaces 21, 24 and the side surfaces 22, 25 of the support plates 8, such that the support plates 8 reliably contact the rail 12.

The illustrated embodiment may be modified as follows.

The size and outer shape of the support plate 8 in the support base 6 may be changed in accordance with the size and outer shape of the rail 12.

The size and outer shape of magnetic sticking portion 10 in the support base 6 may be changed in accordance with the size and outer shape of the rail 12.

The upper side surface 22 and the lower side surface 25 of each support plate 8 in the support base 6 may be omitted.

The magnetic sticking portion 10 may be mounted on the upper portion or the lower portion of the support base 6 in accordance with the size and shape of the rail 12.

Therefore, the present examples and embodiments are to be considered as illustrative and not restrictive and the invention is not to be limited to the details given herein, but may be modified within the scope and equivalence of the appended claims.

What is claimed is:

1. A rail drilling machine for drilling coupling holes in the web of a rail, wherein a head and a foot are formed in an upper portion and a lower portion of the rail, respectively, so as to extend along the longitudinal direction of the rail, the web being formed between the head and the foot so as to extend along the head and the foot, wherein the rail drilling machine includes a drive source, a cutter support mechanism, and a support base, the cutter support mechanism having a cutter attaching portion that is driven by the drive source to rotate, and the support base supporting the drive source and the cutter support mechanism, wherein, in a state where the rail drilling machine is attached to the rail, the drive source, the cutter support mechanism, and the support base are located on one side in the widthwise direction of the head, foot, and web of the rail, wherein a support plate having an upper support surface and a lower support surface is provided at each of both ends of the support base in a longitudinal direction, and wherein the upper support surface and the lower support surface of each support plate contact a lower surface of the rail head and an upper surface of the rail foot, respectively, so that the support base is prevented from moving vertically with respect to the rail, wherein the support base has a magnetic sticking portion located between the support plates, the magnetic sticking portion having a sticking surface that is stuck to a side surface of the rail web, wherein, in a state where the sticking surface of the magnetic sticking portion is stuck to the side surface of the web, the cutter attaching portion of the cutter support mechanism is arranged in such a manner that a rotation axis of the cutter attaching portion extends, on an outer side of the support base, toward the web, and wherein each support plate has two side surfaces that contact a side surface of the rail head and a side surface of the rail foot, respectively, in a state where the sticking surface of the magnetic sticking portion is stuck to the side surface of the web.

2. The rail drilling machine according to claim 1, wherein each support plate has an upper end surface, which is located at a higher position than the upper support surface in a state where the sticking surface of the magnetic sticking portion is stuck to the side surface of the web, wherein the upper end surface of each support plate is located at a lower position than the upper surface of the rail head, and wherein a space is formed between the upper end surface of each support plate and the side surface of the rail head.

3. The rail drilling machine according to claim 2, wherein the space extends from the side surface of the rail head to a proximal portion of a lever that is provided in the cutter support mechanism in a state where the sticking surface of the magnetic sticking portion is stuck to the side surface of the web.

4. The rail drilling machine according to claim 1, wherein, in a state where the sticking surface is stuck to the side surface of the web, the sticking surface of the magnetic sticking portion projects toward the side surface of the web from side edges of the support plates, the side edge of each support plate being located between the upper support surface and the lower support surface of the support plate.

* * * * *